US006787081B2

(12) United States Patent
Jen

(10) Patent No.: US 6,787,081 B2
(45) Date of Patent: Sep. 7, 2004

(54) MANUFACTURING METHOD FOR DIFFERENTIAL DENIER AND DIFFERENTIAL CROSS SECTION FIBER AND FABRIC

(75) Inventor: Zo-Chun Jen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 343 days.

(21) Appl. No.: 10/014,598

(22) Filed: Dec. 14, 2001

(65) Prior Publication Data

US 2003/0111763 A1 Jun. 19, 2003

(51) Int. Cl.[7] ..... D01B 9/00
(52) U.S. Cl. ..... 264/103; 264/172.12
(58) Field of Search ..... 264/103, 172.12

(56) References Cited

U.S. PATENT DOCUMENTS

2003/0052432 A1 * 3/2003 Osaka et al. ..... 264/103

FOREIGN PATENT DOCUMENTS

CN 1208780 A * 2/1999
JP 6-041868 * 2/1994
JP 6-287835 * 10/1994
JP 9-59826 * 3/1997

* cited by examiner

*Primary Examiner*—Laura Edwards
(74) *Attorney, Agent, or Firm*—Bacon & Thomas

(57) ABSTRACT

A manufacturing method for differential denier and differential cross section fiber and fabric is provided, wherein the method comprising melting two polymers having different alkali dissolution rate respectively, blending the two polymers in an adjusted ratio, then spinning the blend from a pack assembly consisting of distributor for producing general split type microfiber and spinnerette with spinning orifice of different shape to produce fiber, which is directly formed into SDY (spin draw yarn) subjecting to a direct spin-draw process, or formed into a flat yarn and draw texture yarn subjecting to draw twisting process and false twisting process or formed into a composite flat yarn and composite draw texture yarn subjecting to composite draw twisting process and composite false twist process; spinning said SDY, flat yarn, draw texture yarn, composite flat yarn or composite draw texture yarn to fabric and subjecting the fabric to alkali treatment to obtain fabric with differential denier and differential cross section fabric in excellent tactility and luster.

3 Claims, 4 Drawing Sheets

7

8

9

10

11

12

MANUFACTURING METHOD FOR DIFFERENTIAL DENIER AND DIFFERENTIAL CROSS SECTION FIBER AND FABRIC

FIELD OF THE INVENTION

The present invention relates to a manufacturing method for differential denier and differential cross section fiber and fabric.

DESCRIPTION OF THE PRIOR ART

For a long time, synthetic fiber serves as garments. As the demand to the tactility and mechanical property of synthetic fibers requested by the consumer are increasing, the fiber industry has been actively engaging in the study, trying to develop a fiber fabric having differential denier and differential cross section and featuring in the similar character with the tactility and luster of natural silk fiber to satisfy the consumer's needs. For this purpose, several patents have been disclosed recently, such as JP-A-6-41868/1994, JP-A-6-287835/1994, JP-A-9-59826/1997 and Chinese Patent Application Publication CN1208780A published on Feb. 24, 1999 etc., wherein two polymers with different alkali dissolution rate are melted respectively, after being blended in an adjusted ratio, a static mixing element or a static mixer is introduced to obtain a full blending, then after spinning a fiber with differential denier and differential cross section is formed. When produced in this method, a static mixer is mounted into the pack assembly. However, in order to save space of equipment, the size of pack assembly is not too large; so the size of static mixer is needed generally to reduce to a limited size to be amounted into the pack assembly. In addition, in order to obtain a better blending effect, the number of element in the static mixer is needed to be a specific number in general. But when the size of static mixer is reduced and the number of mixing element is increased, some problems appear, such as: static mixer is expensive; when the polymer passes through the static mixer, due to the high pressure drop, it imposes an adverse effect on the life-span of the pack assembly; due to the heat splitting released by the polymer, the fiber strength is decreased and breakage of the yarn tends to occur more frequently, therefore influencing the product quality.

Methods to the Problems

In order to solve above problems, the present inventor develops the following method after constant study, which comprising melting two polymers with different alkali dissolution rate respectively, blending the two polymers in an adjusted ratio, then spinning the blend from a pack assembly consisting of distributor for producing general split type microfiber and spinnerette with spinning orifice of different shape to produce fiber, which is directly formed into SDY (spin draw yarn) subjecting to a direct spin-draw process, or formed into a flat yarn and draw texture yarn subjecting to draw twisting process and false twisting process or formed into a composite flat yarn and composite draw texture yarn subjecting to composite draw twisting process and composite false twisting process; spinning said SDY, flat yarn, draw texture yarn, composite flat yarn or composite draw texture yarn to fabric and subjecting the fabric to alkali treatment to obtain fabric with differential denier and differential cross section fabric in excellent tactility and luster.

The method is described in particular as follows:

Two polymers with different alkali dissolution rate, such as polyester polymers, are prepared, wherein a modified polyester polymer with a quicker alkali dissolution rate is prepared by adding a third component such as diethylene glycol, propylene glycol, cyclohexamethylene glycol, polyethylene glycol, terephthalic acid, isophthalic acid, sulfo isophthalic acid, adipic acid, azelaic acid and sebacic acid into the polyester polymer and subjecting to polymerization; and a general polyester polymer unmodified is used as a polyester polymer with a slower alkali dissolution rate. Both of the polymers with different alkali dissolution rate are added to the NaOH solution at a temperature of 105° C. and at a concentration of 1.0 wt %, the bath ratio of the polymers to the alkali solution is adjusted to 1:45, after 10 minutes, the ratio of the polymer with a quicker dissolution rate to the polymer with a slower dissolution rate in the alkali solution reaches to 275:1.

The two polymers with different alkali dissolution rate is melted respectively, then blended in an adjusted ratio; the blending ratio of polymer with a quicker dissolution rate to the polymer with a slower dissolution rate is in the range of 85:15 to 50:50, generally, the ratio of polymer with a quicker dissolution rate should not be too small; if the ratio is less than 15%, the fabric produced shall not obtain the delicate tactility after alkali treatment; if the ratio of polymer with a quicker dissolution rate exceeds 50%, after alkali treatment, the fabric has a monofilament which is too thin to obtain the proper effect of differential denier and differential cross section, and too large proportion of alkali treatment shall raise the manufacturing cost and induce insufficient tear strength of the fabric, so the most proper ratio of polymer with a quicker dissolution rate to the polymer with a slower dissolution rate is in the range of 85:15 to 50:50.

Metering pump is used to adjust the blending ratio of two melted polymers with different alkali dissolution rate to the range of 85:15 to 50:50, and the two polymers are fed into the pack assembly illustrated in FIG. 1, wherein 1 is a polymer with a slower alkali dissolution rate; 2 is a polymer with a quicker alkali dissolution rate; 3 is filter sand; 4 is filter screen; 5 is a distributor for producing general split type microfiber; 6 is a spinnetrtte with spinning orifice of different shape. The two melted polymers, polymer 1 and polymer 2, with different alkali dissolution rate are fed into the pack assembly by a metering pump, after that, they pass through the filter sand 3 and filter screen 4 to remove the impurity in the polymers, then pass through the distributor for producing general split type microfiber 5, where the two polymers are split and arranged, finally the polymers pass through the spinnetrtte with spinning orifice of different shape 6 to produce fibers with differential cross section exhibiting irregular arrangement.

The strand of filament spun from the spinnetrtte with spinning orifice of different shape, can be cooled, oiled and wound to obtain POY (partially oriented yarn) or MOY (middle oriented yarn), or can be cooled, oiled, directly spun-drawn and wound to obtain SDY (spin draw yarn). The POY and MOY can be produced into flat yarn and draw texture yarn subjecting to the draw twisting process and false twisting process, or they can combine with other type of yarn to produce composite flat yarn or composite draw texture yarn subjecting to the draw twisting process and false twisting process. Subjecting the fabric produced by above described flat yarn, draw texture yarn, composite flat yarn, composite draw texture yarn or SDY (spin draw yarn) to alkali treatment can obtain fabric with differential denier and differential cross section in excellent tactility and luster.

FIG. 2 is an illustrative view of the split design used by the distributor for producing general split type microfiber according to the invention, wherein 7 is in 12 splits; 8 is in 16 splits; 9 is in 24 splits, the more splits the distributor has, the more significant blending effect will be obtained by the two polymers passing through the spinnerette with spinning orifice of different shape, but the distributor is extremely expensive. The present invention just illustrates 3 types of split design in FIG. 2, but the 3 types of split design should not be considered as a limitation to the present invention.

FIG. 3 is an illustrative view of the shape design of the spinnerette with spinning orifice of different shape according to the invention, wherein 10 is a "+" shaped spinning orifice; 11 is an octagon shaped spinning orifice; 12 is a Y-shaped spinning orifice. Spinnerette with spinning orifice of different shape refers to the designed spinnerette with non-round spinning orifice, if a spinnerette with a round spinning orifice is used, the fiber produced shall be the same with the split type microfiber commercially available at present, but the cross section of the fiber has a regular split type arrangement, after alkali treatment such a fiber exhibits same cross section and denier without any variation occurred, therefore it's impossible to produce fabric with differential denier and differential cross section in excellent tactility and luster. The design of the spinnerette with spinning orifice of different shape according to the invention is not limited to just 3 types of design illustrated in FIG. 3, but the design of the general shape of spinning orifice should follow the principle that the cross section of the fiber should be designed to have an larger surface area, because enlarging the contact area between the fiber and the alkali solution on alkali treatment can advantageously induce the alkali treatment.

EXAMPLE

A polyester polymer with a slower alkali dissolution rate and in a viscosity of 3000 poise is blended with a polyester polymer with a quicker alkali dissolution rate and in a viscosity of 3500 poise which including a polyethylene glycol component and a sulfo isophthalic acid component, and the blending ratio of two polymers is adjusted; the blending ratio of the polymer with a slower alkali dissolution rate to the polymer with a quicker alkali dissolution rate is maintained to 70:30. In the pack assembly, a distributor for producing general split type microfiber has a 16 splits design, the shape design of the spinnerette with spinning orifice of different shape is a "+" shaped spinning orifice with 48 orifices in number at a spinning temperature of 291° C., the winding speed is 2500 meter/minute, the filament produced is at the denier of 126 dtex, tensile strength of 1.6 cN/dtex, elongation rate of 160%, and the cross section shape of monofilament is illustrated in FIG. 4.

COMPARATIVE EXAMPLE

The same composition of polymers, same blending ratio and same "+" shaped spinnerette with spinning orifice of differential shape are repeated, except that the distributor for producing general split type microfiber with a split design of 16 splits is replaced by a static mixer with 6 mixing elements. The experiment was conducted at the temperature of 291° C. and winding speed of 2500 meter/minute, the fiber produced is at the denier of 126 dtex, tensile strength of 1.45 cN/dtex, elongation rate of 155%, and the cross section shape of monofilament is illustrated in FIG. 5.

As the above experiments shown, the fiber with differential denier and differential cross section produced according to the invention (the cross section shape of monofilament is illustrated in FIG. 4) and the fiber with differential denier and differential cross section produced according to the comparative example (the cross section shape of monofilament is illustrated in FIG. 5) both have the feature that the monofilament has a different cross section and exhibits irregular arrangement, but the fiber with differential denier and differential cross section produced according to the invention has a great advantage in fiber strength and elongation rate as compared with the fiber with differential denier and differential cross section produced according to the comparative example; furthermore, the present invention does not require use of a static mixer, reducing the purchasing cost of equipment.

NUMERALS USED IN THIS INVENTION

Figure 1:
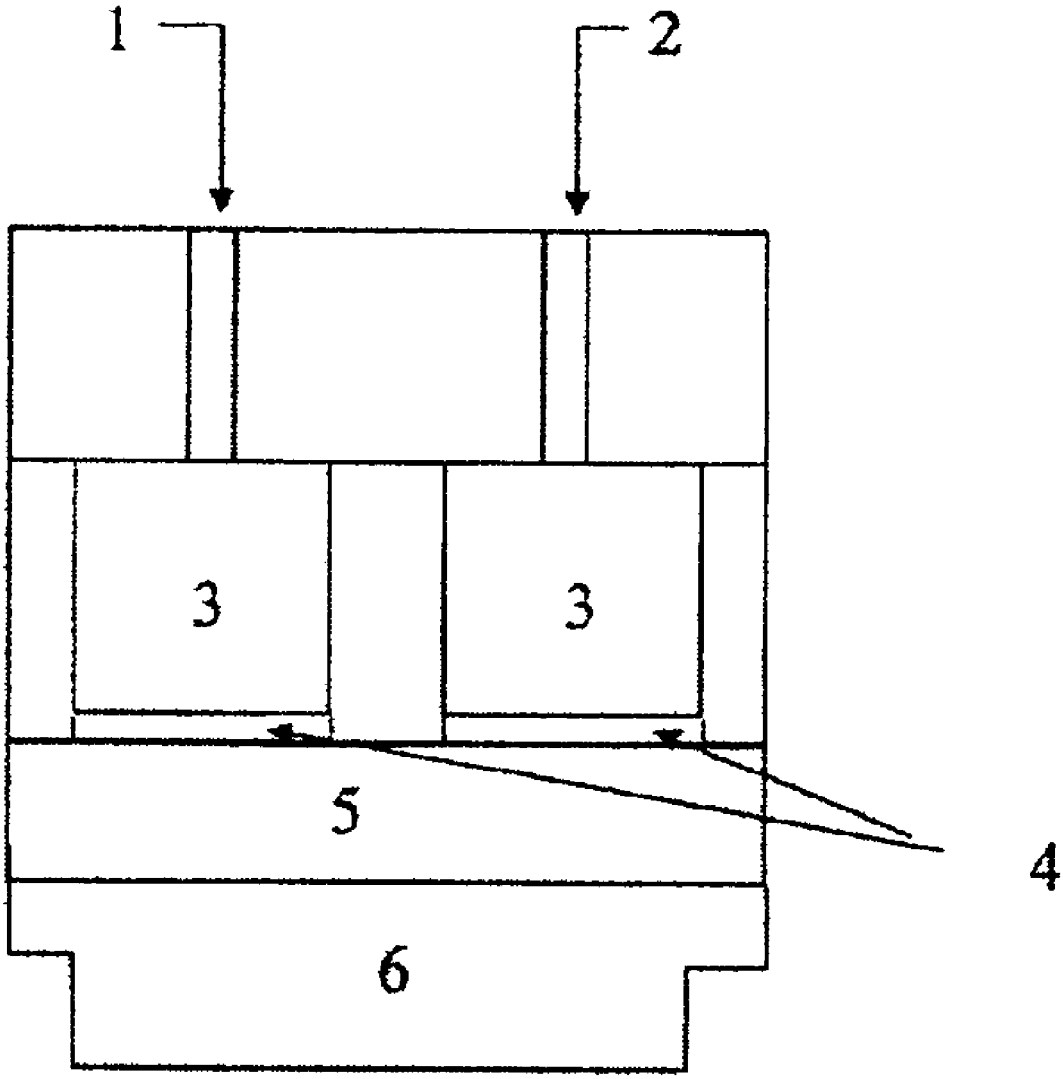
FIG. 1 is a schematic view of the cross section of the pack assembly according to the invention.
Figure 2:
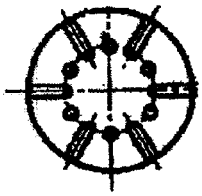
FIG. 2 is a split design schematic view of the distributor for producing general split type microfiber according to the invention.
Figure 2:
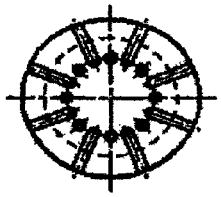
Figure 2:
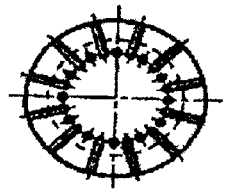
Figure 3:
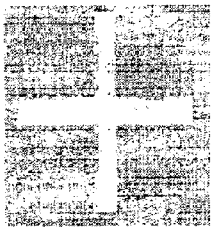
FIG. 3 is a design schematic view of the spinnerette with spinning orifice of different shape according to the invention.
Figure 3:
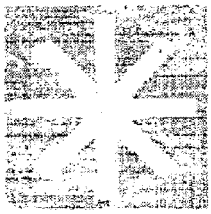
Figure 3:
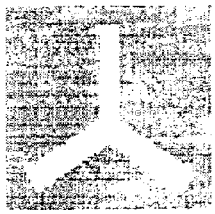
Figure 4:
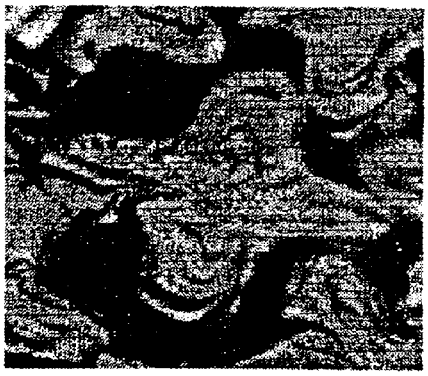
FIG. 4 is a cross section view of the fiber with the differential denier and differential cross section according to the invention
Figure 5:
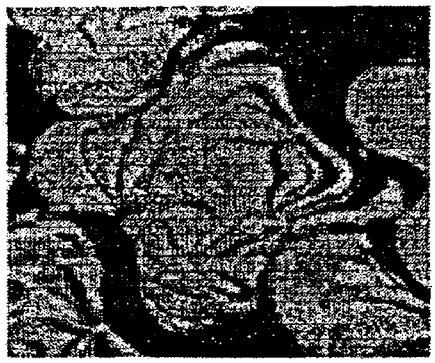
FIG. 5 is a cross section view of the fiber with the differential denier and differential cross section according to the comparative example.

1: a polymer with the slower alkali dissolution rate
2: a polymer with the quicker alkali dissolution rate
3: a filter sand
4: a filter screen
5: a distributor for producing general split type microfiber
6: a spinnerette with spinning orifice of different shape
7: a distributor for producing general split type microfiber with a split design of 12 splits
8: a distributor for producing general split type microfiber with a split design of 16 splits
9: a distributor for producing general split type microfiber with a split design of 24 splits
10: a spinnerette with the "+" shaped spinning orifice design
11: a spinnerette with the octagon shaped spinning orifice design
12: a spinnerette with the Y-shaped spinning orifice design

What is claimed is:

1. A manufacturing method for differential denier and differential cross section fiber and fabric, which comprises melting two polymers with different alkali dissolution rates, and blending said two polymers in a controlled mixing ratio wherein the mixing ratio of the polymer having a slower dissolution rate to the polymer having a quicker dissolution rate is in the range of 85:15 to 50:50; and spinning the two polymers from a pack assembly consisting of a distributor for producing general split type microfiber and spinnerette with spinning orifice of different shapes to produce fiber.

2. The manufacturing method for differential denier and differential cross section fiber according to claim 1, wherein said polymer having a quicker alkali dissolution rate is a polyester comprising adding a polymer into at least one or more of a third component comprising diethylene glycol, propylene glycol, cyclohexamethylene glycol, polyethylene glycol, terephthalic acid, isophthalic acid, sulfo isophthalic acid, adipic acid, azelaic acid and sebacic acid and subjecting the blend to prepolymerization.

3. The manufacturing method for differential denier and differential cross section fiber according to claim 1, wherein said fiber is woven into fabric.

* * * * *